US007703727B2

(12) United States Patent
Selness

(10) Patent No.: US 7,703,727 B2
(45) Date of Patent: Apr. 27, 2010

(54) UNIVERSAL ADJUSTABLE SPACER ASSEMBLY

(76) Inventor: Jerry N. Selness, 4811 Monongahela St., San Diego, CA (US) 92117

( * ) Notice: Subject to any disclaimer, the term of this patent is extended or adjusted under 35 U.S.C. 154(b) by 1182 days.

(21) Appl. No.: 11/185,846

(22) Filed: Jul. 21, 2005

(65) Prior Publication Data

US 2006/0022180 A1 Feb. 2, 2006

Related U.S. Application Data

(60) Provisional application No. 60/590,122, filed on Jul. 21, 2004.

(51) Int. Cl.
*F16M 11/00* (2006.01)

(52) U.S. Cl. ..... 248/188.2; 248/125.2

(58) Field of Classification Search ..... 248/668, 248/656, 125.2, 222.13, 188.1, 188.2, 188.4
See application file for complete search history.

(56) References Cited

U.S. PATENT DOCUMENTS 3,171,632 A * 3/1965 Jines ..... 254/104
3,528,691 A * 9/1970 Matich, Jr. ..... 403/356
4,135,335 A * 1/1979 Jensen ..... 52/126.1
4,776,548 A * 10/1988 Bezenek ..... 248/188.2
4,858,865 A * 8/1989 Schrepfer ..... 248/188.2
5,253,964 A * 10/1993 Swemmer ..... 411/79
5,584,464 A * 12/1996 Whittaker ..... 248/678
H2009 H * 1/2002 Martin et al. ..... 248/677

* cited by examiner

*Primary Examiner*—J. Allen Shriver, II
*Assistant Examiner*—Steven M Marsh
(74) *Attorney, Agent, or Firm*—The Nath Law Group; Jerald L. Meyer; Jonathan A. Kidney

(57) ABSTRACT

In a universal, adjustable spacer assembly, first and second opposed wedges have faces that are inclined with respect to a longitudinal axis. As the wedges translate along the longitudinal axis with respect to one another, vertical distance between an upper face and a lower face of the first and second wedges respectively changes. Longitudinally displaced portions of a rotatable member such as a threaded rod are received in a first and a second collar member pivotally mounted with respect to the first and second wedges respectively. As the rod rotates, longitudinal distance between the collar members changes, and the wedges slide against each other, the collar members rotate within each wedge. In a further form, opposing track members may be fixed to inclined surfaces of the first and second wedges respectively.

6 Claims, 10 Drawing Sheets

UNIVERSAL ADJUSTABLE SPACER ASSEMBLY

CROSS-REFERENCE TO RELATED APPLICATIONS

The present application claims priority to U.S. Provisional Patent Application Ser. No. 60/590,122 filed Jul. 21, 2004, the disclosure of which is incorporated herein by reference in its entirety.

FIELD OF THE INVENTION

The present subject matter relates to an adjustable spacer assembly.

BACKGROUND OF THE INVENTION

Adjustable spacer assemblies are used in many contexts. They may be used to fill space in order to secure an item against motion within a container. When a spacer is used, it may replace or supplement the use of packing material. Adjustable spacer assemblies may be used for furniture leveling. Adjustable spacer assemblies are used in orthopedic surgery in such applications spinal fusion to fill space between adjacent vertebrae surrounding a missing vertebra. Adjustable spacer assemblies may be used to set the height of a worktable or load-bearing surface.

Various shortcomings of the prior art include lack of flexibility in performance or complexity in construction. U.S. Pat. No. 5,924,661, in describing the background of the invention, refers to a prior art mechanism for leveling items such as heavy machinery. A pair of freely sliding opposed wedges are interconnected for movement by a threaded shaft. Further described are a number of approaches to furniture stabilizing that suggest the use of a combination of wedges having ridges that intermesh with each other for adjustable stability. Mechanisms simply using two opposed wedges with forces applied to a threaded shaft parallel to long, flat surfaces of the wedges do not make the most efficient use of force applied to the wedges. Such mechanisms also tend to bind. Forming ridges in wedges creates additional expense in manufacture.

In orthopedic surgery, a number of adjustable intervertebral implants have been provided. One such implant is disclosed in U.S. Pat. No. 6,176,882. A mechanism for varying the height of the implant is housed between fixed sidewalls. The mechanism includes first and second wedges which are moved horizontally by a threaded bolt to displace third and fourth wedges vertically. Aspects of complexity of this apparatus include the requirement to have opposite ends of the bolt formed with a left hand thread and a right hand thread respectively. U.S. Pat. No. 6,368,351 includes an intervertebral implant assembly in which a cylinder on a threaded bolt is displaced as the bolt turns to cam against two facing slanted surfaces included in upper and lower members respectively. The upper and lower members are hinged at one end. This mechanism only tilts the upper and lower members with respect to each other. It does not displace both ends of the upper and lower members from each other.

U.S. Pat. No. 6,889,946 discloses a leveling shoe that includes first and second wedge members that are moved to adjust the height of a support plate having wedges formed on its lower surface. U.S. Pat. No. 6,463,114 discloses a jacking device which includes a central threaded wedge member that bears against surrounding wedge members to produce relative movements. These patents exemplify the prevalent practice of using different structures for different applications.

These structures are not "universal" in application. While no structure is truly universal, the term universal may be applied to a device which has a wide range of applications.

SUMMARY OF THE INVENTION

Briefly stated, in accordance with embodiments of the present invention, there is provided a universal, adjustable spacer assembly. First and second opposed wedges have faces that are inclined with respect to a longitudinal axis. As the wedges translate along the longitudinal axis with respect to one another, vertical distance between an upper face and a lower face of the first and second wedges respectively changes. Longitudinally displaced portions of a rotatable member such as a threaded rod are received in a first and a second collar member pivotally mounted with respect to the first and second wedges respectively. As the rod rotates, longitudinal distance between the collar members changes, the wedges slide against each other, and the collar members rotate within each wedge. In a further form, opposing track members may be fixed to inclined surfaces of the first and second wedges respectively.

In further forms, the adjustable spacer assembly is adapted to a number of different applications.

BRIEF DESCRIPTION OF THE DRAWINGS

The invention may be further understood by reference to the following description taken in connection with the following drawings.

DETAILED DESCRIPTION

Embodiments of the present invention utilize an opposed wedge mechanism in which first and second wedges translate with respect to one another in a longitudinal dimension. As inclined faces of the wedges slide along each other, the vertical distance between an upper horizontal surface on the first wedge and a lower surface on the second wedge will increase or decrease, depending on the direction in which the translation takes place. Directions such as vertical, horizontal, transverse and longitudinal are used in the present description only in a relative sense in order to define orientation of components with respect to each other. Operation of the embodiments is not dependent on particular orientation of the spacer assembly.

A universal adjustable spacer assembly 1 comprises a wedge pair 4 and a semi-longitudinal connector 6. Turning the semi-longitudina1 connector 6, when threaded, translates wedges in the wedge pair 4 with respect to each other in a longitudinal direction to vary spacing between upper and lower surfaces of the wedge pair 4. In many applications, wedges within the wedge pair 4 will normally comprise triangular solids. However, this is not necessary. Wedge surfaces need not necessarily be flat, although such a construction will be preferred in many applications. The wedge pair may be made of any of a number of materials such as plastic foam, urethane plastic, metal or wood.

Figure 1:
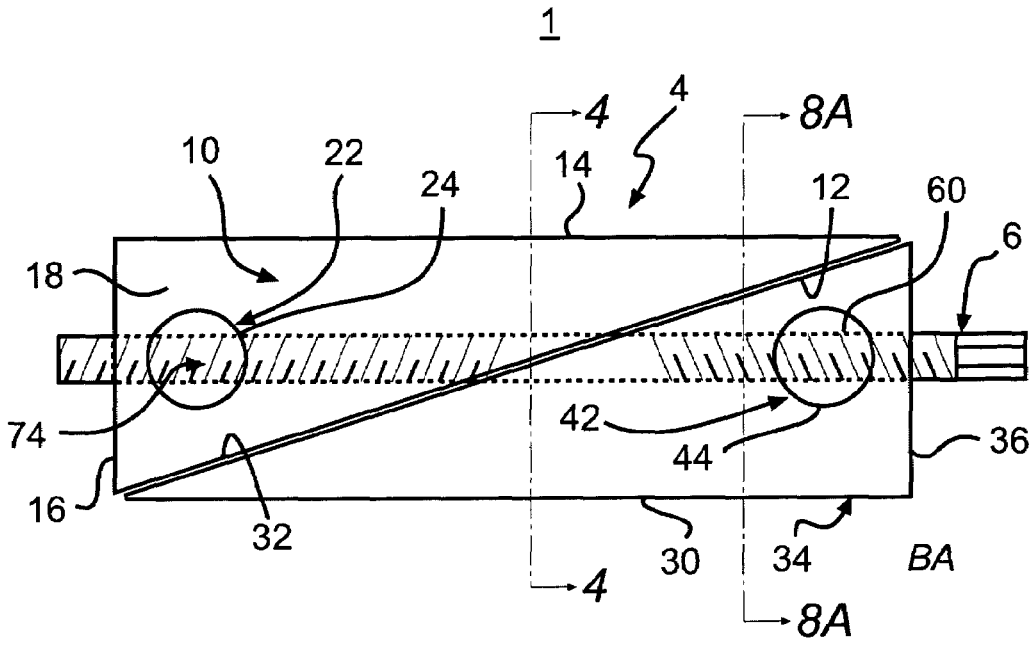
FIGS. 1 and 2 are respectively a front and side elevation of a spacer assembly constructed in accordance with an embodiment of the present invention.
Figure 2:
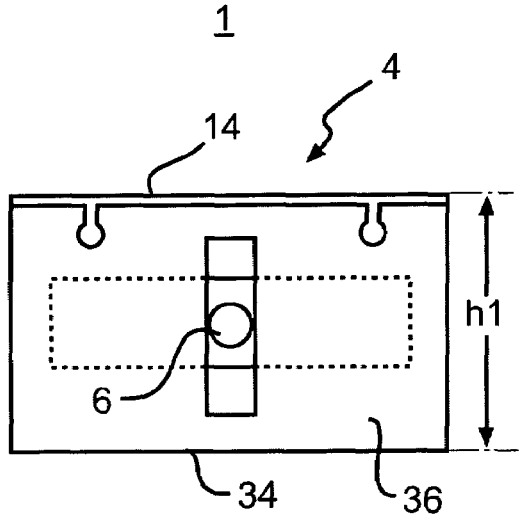
Figure 3:
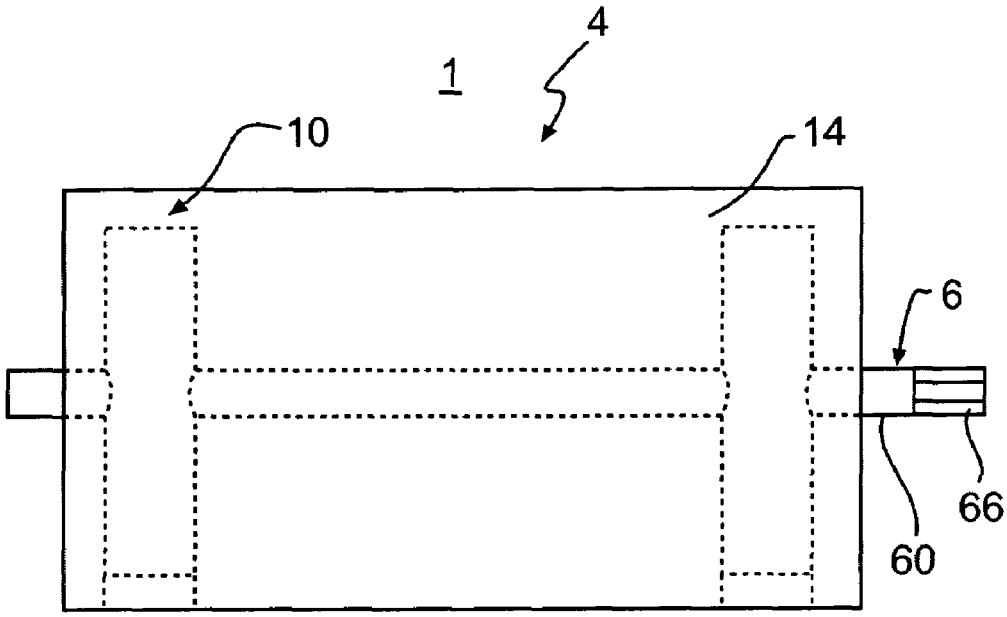
FIG. 3 is a plan view of the embodiment of FIGS. 1 and 2.
Figure 4:
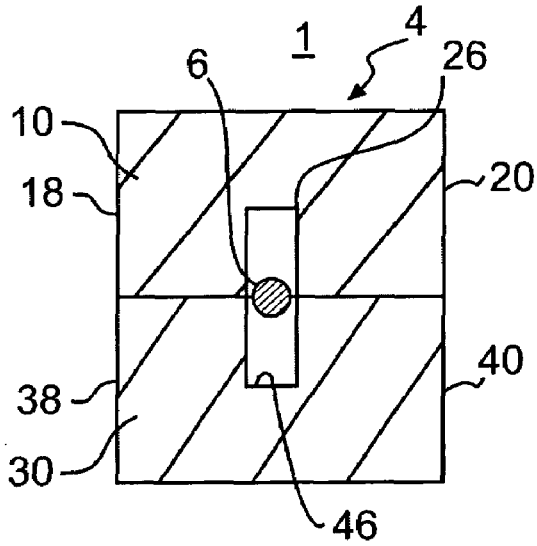
FIG. 4 is a cross sectional view taken along line 4-4 of FIG. 1.
Figure 5:
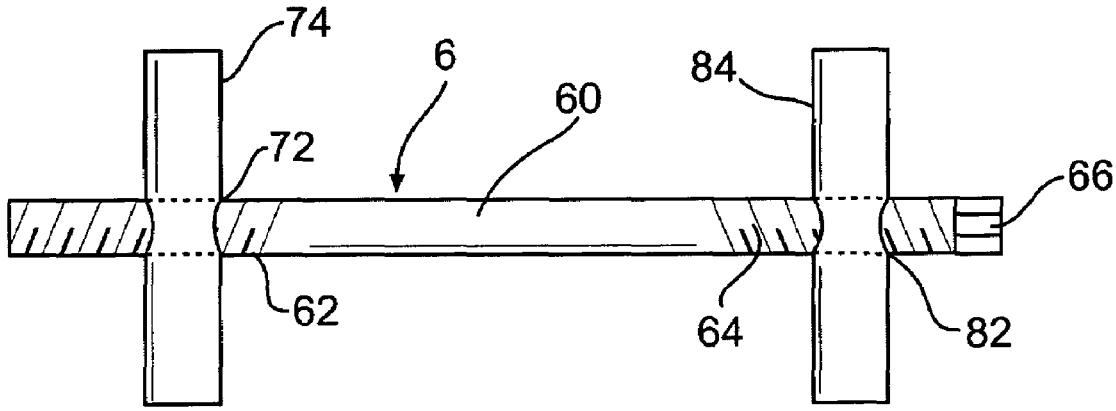
FIGS. 5 and 6 are a plan view and a front elevation respectively of a one form of variable length connector.
Figure 6:
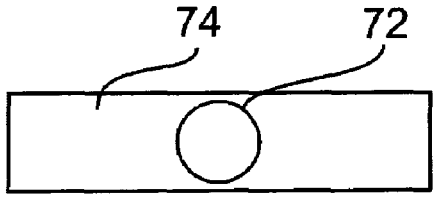
Figure 7:
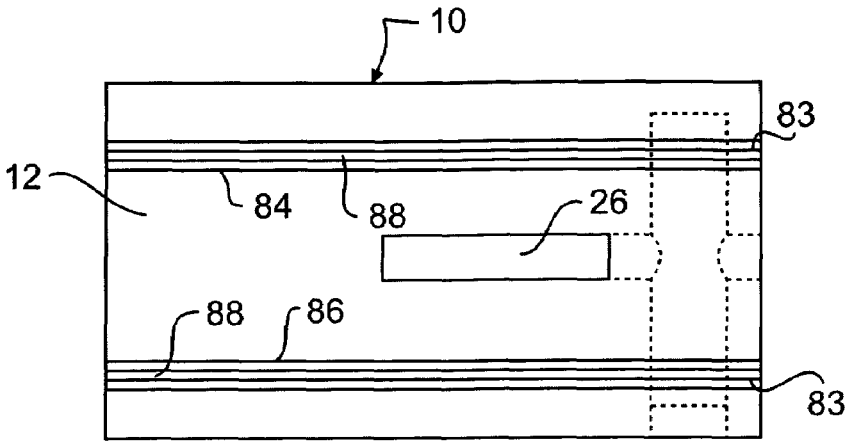
FIGS. 7 and 8 are each a plan view of the inclined surfaces of first and second wedges respectively.
Figure 8A:
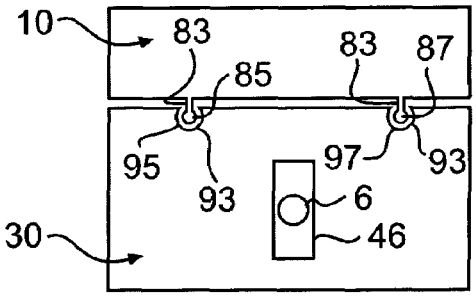
FIG. 8A is a cross section taken along line 8A-8A of FIG. 1.
Figure 8:
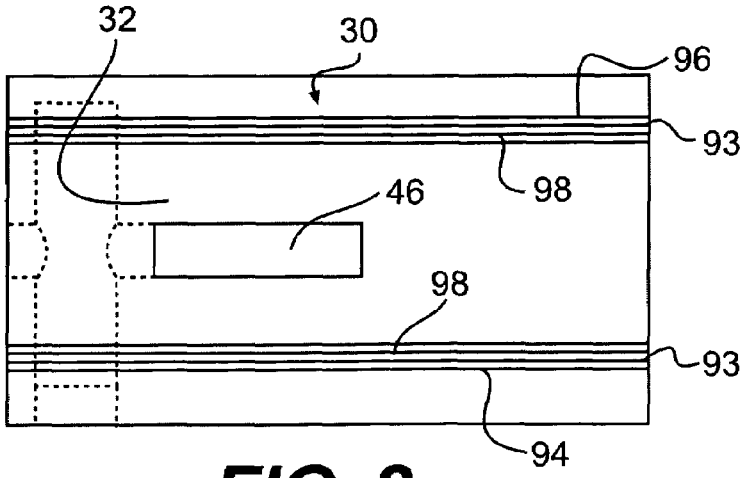
Figure 9:
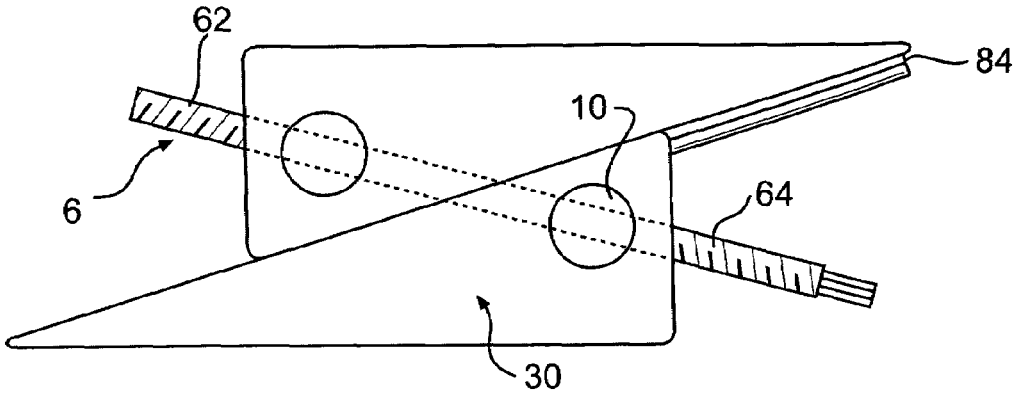
FIGS. 9-11 are respectively a front elevation, a plan view and a side elevation of spacer assembly in which wedges are displaced with respect to their relative positions in FIGS. 1-4.
Figure 10:
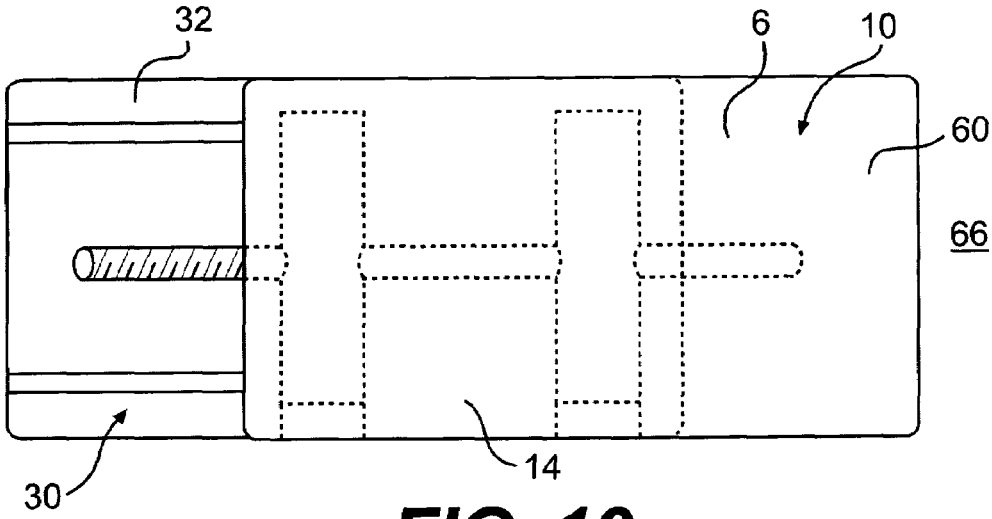
Figure 11:
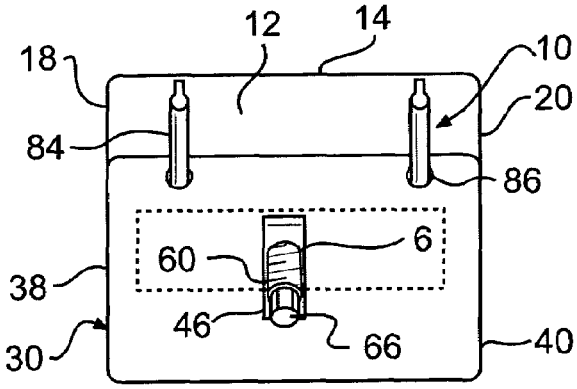

A first group of embodiments is described with respect to FIGS. 1-11. FIGS. 1 and 2 are respectively a front and side elevation of a spacer assembly 1 constructed in accordance with an embodiment of the present invention. FIG. 3 is a plan view of the embodiment of FIGS. 1 and 2, and FIG. 4 is a cross sectional view taken along line 4-4 of FIG. 1. FIGS. 5 and 6 are a plan view and a front elevation respectively of a one form of a semi-longitudinal connector. FIGS. 7 and 8 are each a plan view of the inclined surfaces of first and second wedges respectively. FIGS. 9-11 are respectively a front elevation, a plan view and a side elevation of spacer assembly in which wedges are displaced with respect to their relative positions in FIGS. 1-4

As seen, for example, in FIGS. 1-4, the wedge pair 4 comprises and upper wedge 10 and a lower wedge 30. The upper wedge 10 may comprise a solid forming a right triangle in longitudinal cross section, and includes a horizontal, upper surface 14, a vertical side surface 16 and an inclined surface 12. The upper wedge 10 has first and second transversely displaced, longitudinally extending sides 18 and 20. The upper wedge 10 comprises a connector 22 to connect the upper wedge 10 to the semi-longitudina1 connector 6. In the present illustration, the connector 22 comprises a bore 24 which receives a portion of the semi-longitudinal connector 6 as further described below. If the semi-longitudinal connector 6 is placed between the sides 18 and 20, a longitudinally extending channel 26 is formed in the upper wedge and lower wedge shaped to accommodate the movement and change in angle of the semi-longitudinal connector 6 with respect to the movement of the wedges.

Similarly, as seen, for example, in FIGS. 1-4, the lower wedge 30 may comprise a solid forming a right triangle in longitudinal cross section, and includes a horizontal, lower surface 34, a vertical side surface 36 and an inclined surface 32. The lower wedge 30 has first and second transversely displaced, longitudinally extending sides 38 and 40. The lower wedge 30 comprises a connector 42 to connect the lower wedge 30 to the semi-longitudinal connector 6. In the present illustration, the connector 42 comprises a bore 24 which receives a portion of the semi-longitudinal connector 6 as further described below. If the semi-longitudinal connector 6 is placed between the sides 38 and 40, a longitudinally extending channel 46 is formed in the lower wedge 30 to accommodate the semi-longitudinal connector 6.

The variable length connector 6 is illustrated in further detail in FIGS. 5 and 6. The variable length connector 6 is connected to the upper and lower wedges 10 and 30 to hold the inclined surfaces 12 and 32 in engagement. The variable length connector 6 is connected to a location on each of the upper and lower wedges 10 and 30, such as the connectors 22 and 42, so that the locations are closer or farther apart as the length of the variable length connector 6 changes. Consequently, the inclined surfaces 12 and 32 slide against each other, and the upper and lower wedges 10 and 30 are compressed in the longitudinal degree of freedom or pulled apart to change the vertical spacing of upper and lower surfaces 14 and 34. Many different forms of variable length connector 6 may be provided. Many different forms of drive means may be provided to drive the locations closer or farther apart. In the present illustration, drive means include a threaded rod 60. The threaded rod 60 includes a first threaded section 62 received in the connector 22 in the upper wedge 10. A second threaded section 64 is received in the connector 44 in the lower wedge 30. The threaded sections 62 and 64 may have oppositely directed pitches. When the rod 60 is rotated, items threaded on the sections 62 and 64 will move in opposite linear directions. A driver head 66 on the threaded rod 60 may be provided for convenience in imparting motion. The driver head 66 may comprise a hex head at one end of the rod 60. However, it is not essential that the driver head be at an end of the rod 60.

The threaded section 62 extends through a threaded collar 72 in a connector member 74. The connector member 74 maintains the threaded collar in a fixed volume within the upper wedge 10. The threaded collar 72 may comprise an insert within the connector member 74. Alternatively, the threaded collar 72 may comprise an internal thread integral with the connector member 74. In the present illustration, the connector member 74 comprises a cylinder. The cylinder may be formed to have a clearance with the bore 24 (FIG. 1). The clearance is optimized to minimize lateral movement of the connector member with respect to the bore 24 while allowing for unimpeded rotation of the connector member 74 in the bore 24. Most conveniently, the connector member will comprise a right circular cylinder. However, the cylinder could comprise a square cross section or be of an irregular shape. Similarly, the threaded section 64 extends through a threaded collar 82 in a connector member 84. The connector member 84 is received in the bore 44 of the connector 22 in the lower wedge 30. The connector members 74 and 84 each act as connectors in that they maintain the collars 72 and 82 respectively with a fixed volume of the upper and lower wedges 10 and 30 respectively. They may be viewed as part of the variable length connector 6 in that they hold the collars 72 and 82 respectively.

FIGS. 7 and 8 are each a plan view of the inclined surfaces of the first and second wedges 10 and 30 respectively. In one form, the inclined faces 12 and 32 have tracks 83 and 93 respectively extending in the longitudinal direction to facilitate relative motion. In the present illustration, the track 83 comprises parallel, transversely displaced rails 84 and 86. The rails 84 and 86 may be made of a low-friction material such as Teflon. The rails 84 and 86 may each include a vertically extending key 88. Similarly, the track 93 comprises parallel, transversely displaced rails 94 and 96. The rails 94 and 96 may each include a vertically extending slot 98 to receive a key 88. Mounting the keys 88 in facing slots 98 helps maintain proper transverse alignment of the upper and lower wedges 10 and 30.

Alternatively, the tracks 83 and 93 may comprise a ball and groove arrangement as illustrated in FIG. 8A, which is a cross section taken along line 8A-8A of FIG. 1. In this embodiment, the track 83 may comprise parallel bulb rails 85 and 87. The track 93 may comprises parallel slots 95 and 97. In one embodiment, the upper and lower wedges 10 and 30 may be made of plastic with sufficient deformability so that the bulb rails may be snapped into the slots 95 and 97 respectively. In another alternative form, the bulb rails 85 and 87 and the slots 95 and 97 may have a trapezoidal cross section in order to provide a sliding dovetail joint.

In order to provide spacing between items (not shown) facing and surrounding the upper and lower surfaces 14 and 34, the spacer assembly 1 is positioned between them while in a first state. The first state is one in which the spacer assembly 1 has clearance with the surrounding elements. The first state may also be referred to as the compressed state. Specific illustrations of surrounding elements are further described below. The distance between the upper surface 14 and the lower surface 34 in a compressed state is an arbitrary distance h1. In an expanded state, illustrated in FIGS. 9-11, the distance between the upper surface 14 and the lower surface 34 is a distance h2 selected to fill the space between the surrounding items.

In order to provide for relative translation between the upper wedge 10 and the lower wedge 30, the rod 60 is rotated in a counterclockwise direction. Depending on the size and loading on the adjustable spacer assembly 1, the drive head 66 may be rotated between the thumb and forefinger of a user or may be rotated by a tool such as a socket wrench. The threaded portion 62 causes the rod 60 to move outwardly from the wedge 10. At the same time, the threaded portion 64 causes the rod 60 to move outwardly from the wedge 30. The upper and lower wedges 10 and 30 are pressed together, and the inclined surfaces 12 and 32 slide along each other. The angular orientation of the rod 60 changes with respect to each of the upper and lower wedges 10 and 30, and the connector member 74 and 84 turn within the bores 22 and 42 respectively. As the opposite end faces 16 and 36 (FIG. 1) get closer together, the upper and lower surfaces 14 and 34 get farther apart. The rod 60 is rotated until h2 reaches a predetermined value. The predetermined value may be a preselected distance, or it may simply be the value of h2 at which resistance against the upper and lower surfaces 14 and 34 prevents further rotation of the rod 60. In the expanded position, the adjustable spacer assembly may assume the position illustrated in FIGS. 9-11.

In an embodiment in which the adjustable spacer assembly 1 is used as a spacer in a postal package, for example, the upper and lower wedges 10 and 30 may be made of lightweight materials. If desired, the relative positions of the upper and lower wedges 10 and 30 may be maintained by placing masking tape in a longitudinal direction on the transverse sides of the upper and lower wedges 10 and 30.

Figure 12:
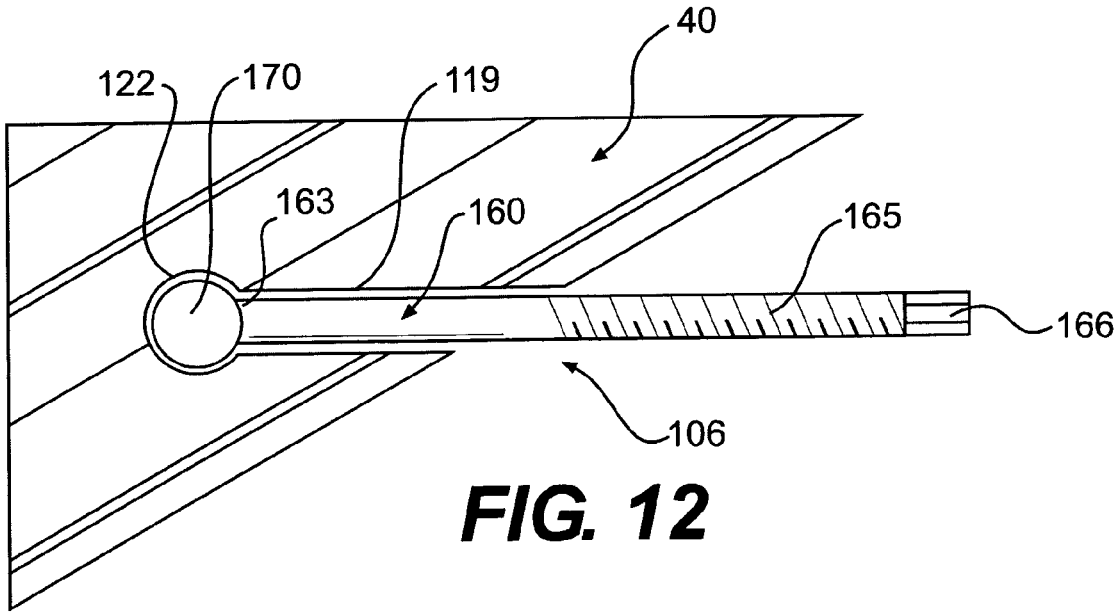
FIGS. 12 is an plan view of a variable length connector with an alternative form of rotation mechanism.
Figure 13:
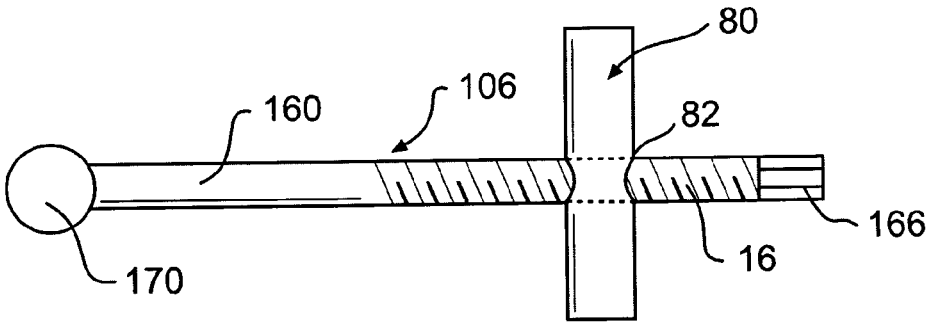
FIG. 13 is a plan view of the rotation mechanism of FIG. 12 assembled to a collar member.

FIG. 12 is an plan view of an alternative variable length connector 106 of rotation mechanism in a cross section of the upper wedge 10, and FIG. 13 is a plan view of the rotation mechanism of FIG. 12 assembled to a collar member. A threaded rod 160 has a first end pivotally 163 received in a ball 170. The threaded rod 160 has a threaded section 165 received in the collar 72 of the connector member 74. A driver head 166 may be included at an end of the rod 160 remote from the ball 170. As the rod 160 is rotationally driven, distance between the collar 82 and the ball 170 changes to cause movement of the adjustable spacer assembly between a compressed and uncompressed positions. The ball 170 is received in a socket 122, which may comprise a bore extending transversely through the upper wedge 10. A transversely extending slot 119 may be provided in the upper wedge 10 to allow movement of the rod 160 to the central, longitudinally extending central channel 26.

Figure 13A:
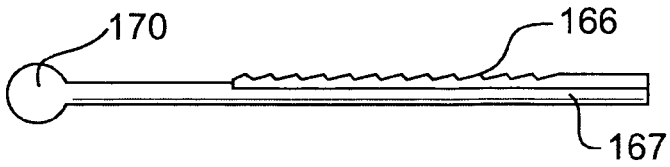
FIGS. 13A and 13B are front and side elevations of a threaded rod unit.
Figure 13B:
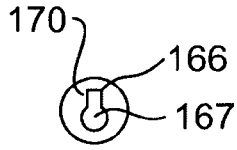
Figure 13C:
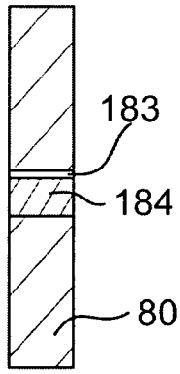
FIGS. 13C and 13D are a cross section and side elevation of an alternative form of connector element 80.
Figure 13D:
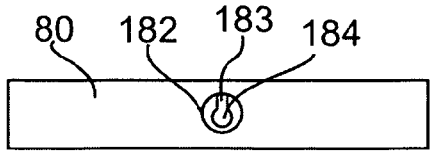

FIGS. 13A-13D represent an alternative form of variable length connector 106. FIGS. 13A and 13B are front and side elevations of a threaded rod unit 161. FIGS. 13C and 13D are a cross section and side elevation of an alternative form of connector element 80. A threaded key 166 extends radially from a central shaft 167. The shaft 167 terminates in the ball 170. The threaded key 166 is received in a longitudinally extending slot 183 of a connector member 80 and may freely slide therein. The slot 183 extends radially from a bore 184 that receives the shaft 167. When the shaft 167 is rotated with respect to the collar 182 in the connector 80, threads of the key 166 are received in and engage a thread 185 circumferentially surrounding the slot 183.

Figure 14:
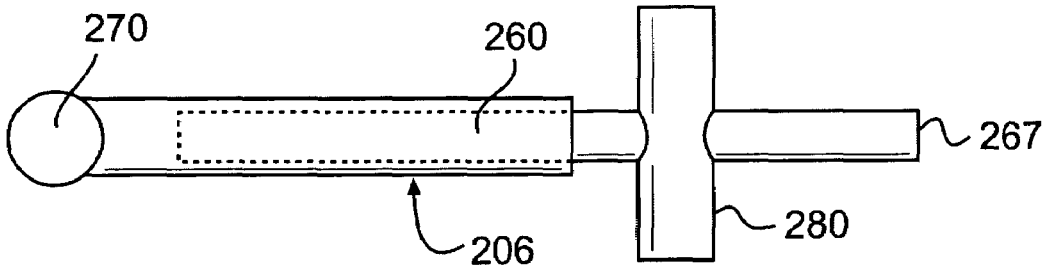
FIGS. 14 and 15 illustrate a variable length connector utilizing a hydraulic cylinder rather than a threaded rod.
Figure 15:
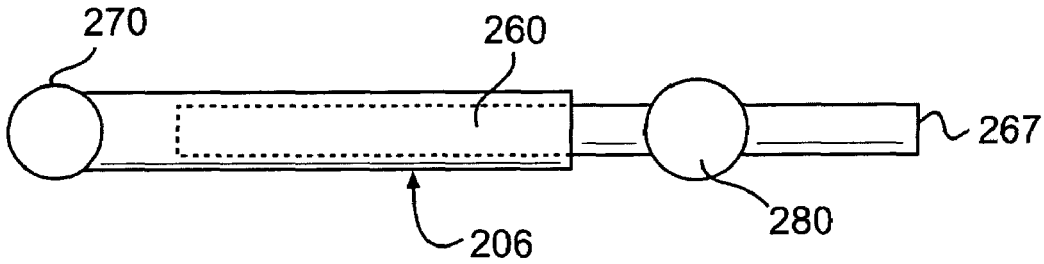

FIGS. 14 and 15 are a plan view and an elevation respectively of a variable length connector 206 utilizing a hydraulic cylinder 260 rather than a threaded rod. Many different forms of fluid-operated cylinders 260 are well-known which include telescoping arms and which are adjustable in length through transfer of fluid from one internal chamber to another. These cylinders may be pneumatic or hydraulic. Relatively displaceable portions of the hydraulic cylinder 260 are respectively received in connector members 270 and 280. The connector member 270 is received in the bore 22 of the upper wedge 10. The connector member 280 is received in the bore 42 of the lower wedge 30. In order to change the length of the hydraulic cylinder 260, an actuator 267 at a longitudinal end of the hydraulic cylinder is depressed to open a normally closed hydraulic valve to permit adjustment of the length of the hydraulic cylinder 260. A user may pull or push the hydraulic cylinder 260 to adjust its length. In large or heavily loaded embodiments, well-known hydraulic pump means may be used to displace hydraulic fluid for length adjustment.

Figure 16:
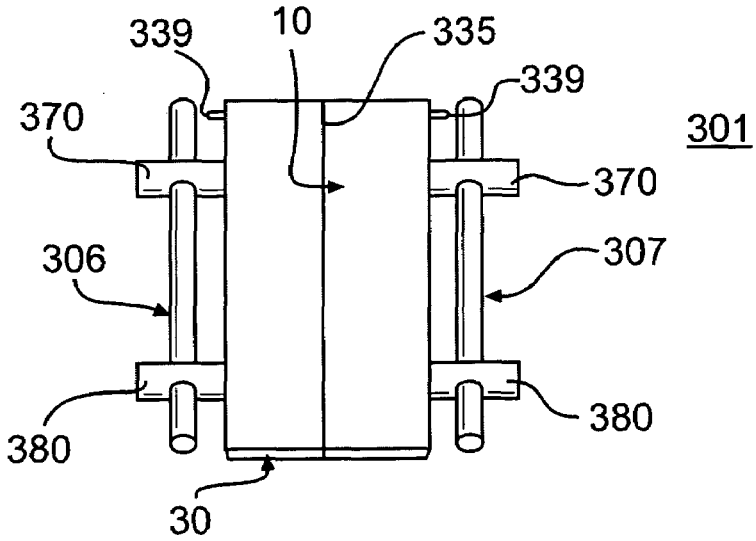
FIG. 16 illustrates an embodiment an embodiment using "outboard" variable length connectors.

FIG. 16 illustrates an adjustable spacer assembly 301 embodiment an embodiment using "outboard" variable length connectors 306 and 307 on either transverse side of the upper and lower wedges 10 and 30. Connector members 370 and 380 extend transversely outwardly of the upper and lower wedges 10 and 30 sufficiently to receive the variable length connectors 306 and 307. The connector members 370 and 380 may extend all the way through the bores 22 and 42 respectively. Alternatively each connector member 370 or 380 may be comprised of two separate transversely extending portions with each portion being received in the wedge 10 or 30 by a ball joint. In this form, a longitudinally extending split 335 is formed in the upper and lower wedges 10 and 30. In a preferred version of this form, the split portions of the upper wedge 10 are both pivoted on a pivot pin 339 extending through a lower corner of the upper wedge 10. The variable length connectors 306 and 307 may be deliberately set to different lengths to help retain the adjustable spacer assembly 301 between non-parallel surfaces.

Figure 17:
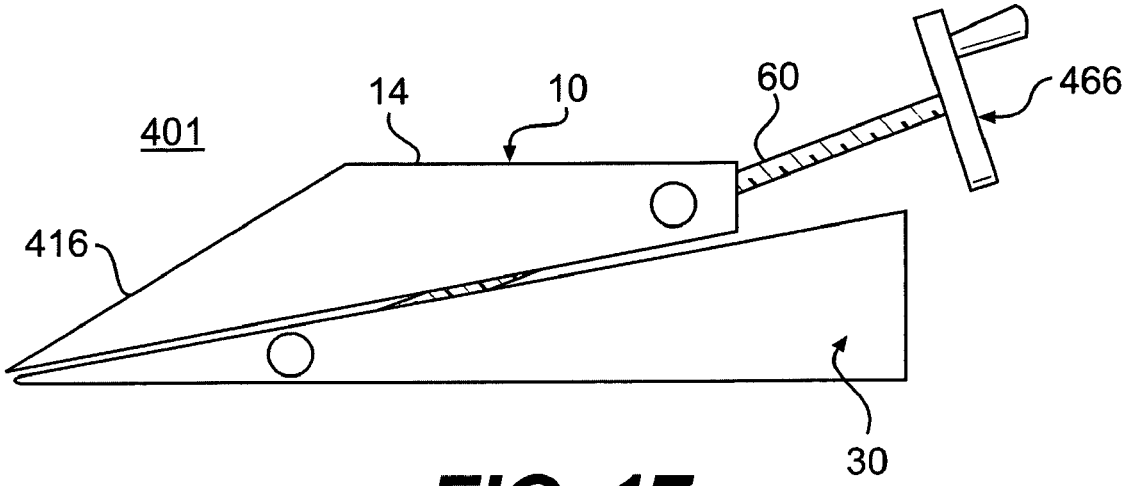
FIGS. 17 and 18 illustrate a ramp and lift device.
Figure 18:
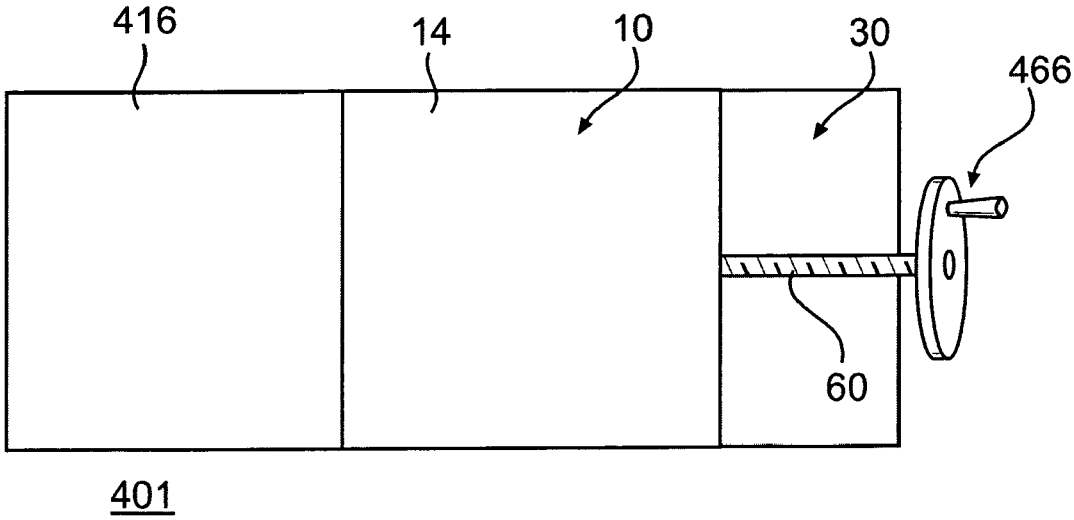

FIGS. 17 and 18 are an elevation and a plan view of a ramp and lift device comprising an adjustable spacer assembly 401. Rather than having a vertical wall 16, the upper wedge 10 comprises a sloped wall 416 which extends substantially to level of the lower surface 34 when the adjustable spacer assembly 401 is in the compressed position. A crank assembly 466 is at an end of drive rod 60.

Figure 19:
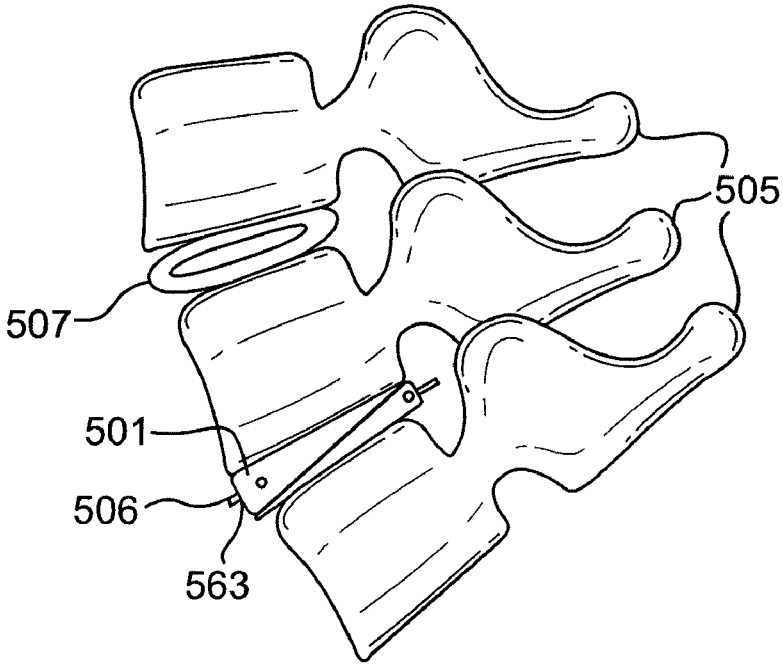
FIG. 19 illustrates an embodiment comprising an intervertebral spacer.

FIG. 19 illustrates an embodiment comprising an intervertebral spacer. In spinal surgery, various forms of spacers are provided for mounting between vertebrae 505 to replace an entire vertebra 505 plus adjoining cartilage 507. Alternatively, either Intervetebral cartilage 507 may be replaced. In the present embodiment, an adjustable spacer assembly 501 is provided including a vernier adjustment mechanism 563 to provide for precise adjustment of a variable length connector 506. The adjustable spacer assembly 501 may be used in connection with osteogenic material to promote spinal fusion and may also be used to deliver medication.

Figure 20:
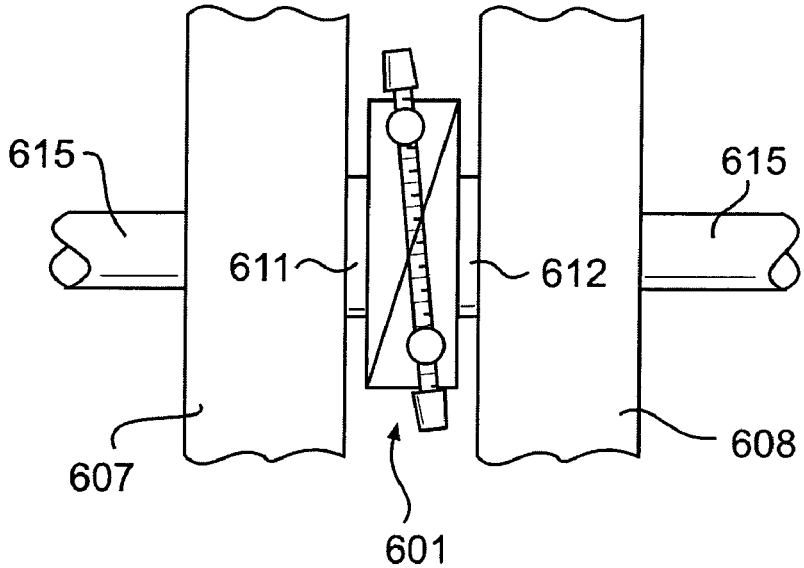
FIG. 20 comprises an adjustable spacer for maintaining spacing between components surrounding rotating machinery.

FIG. 20 comprises an adjustable spacer assembly for maintaining spacing between axially displaced components surrounding rotating machinery. An adjustable spacer assembly 601 is expanded between rotating or non-rotating members 607 and 608. Washers 611 and 612 help maintain the adjustable spacer assembly 601 in engagement with the members 607 and 608 respectively. A rotating shaft 615 extends through an opening in the adjustable spacer assembly 601.

Many variations can be provided in the particular embodiments disclosed to provide an assembly in accordance with the present subject matter. The present subject matter being thus described, it will be apparent that the same may be varied in many ways. Such variations are not to be regarded as a departure from the spirit and scope of the present subject matter, and all such modifications are intended to be within the scope of the appended claims.

What is claimed is:

1. An adjustable spacer assembly comprising:

first and second opposed wedges each having opposed inclined surfaces and a bore extending in a transverse direction;

a semi-longitudinal threaded rod connector having oppositely pitched threads at each end and adjustable in position to determine relative positions of said first and second wedges, said wedges being constrained by said semi-longitudinal threaded rod connector being received within the bore, so that a vertical distance between an upper face and a lower face of said first and second wedges respectively changes as said first wedge is translated in a longitudinal direction with respect to said second wedge in response to a change in position of said semi-longitudinal threaded rod connector; and first and second cylindrical members located at said first and second wedges each to retain said first wedge and said second wedge respectively to said semi-longitudinal threaded rod connector and each permitting pivotal movement of said semi-longitudinal threaded rod connector with respect to one said wedge, wherein one said cylinder member comprises a threaded collar for rotation of said semi-longitudinal threaded rod connector in said threaded collar.

2. The adjustable spacer assembly according to claim 1, wherein said cylindrical members comprises first and second ends extending transversely outwardly from said wedges and wherein said semi-longitudinal threaded rod connector comprises first and second elongated members each extending from said first cylindrical member to said second cylindrical member on either transverse side of said first and second wedges.

3. The adjustable spacer assembly according to claim 1, further comprising first and second mating track members extending longitudinally on said first and second inclined surfaces respectively, wherein said track members comprise low-friction material.

4. The adjustable spacer assembly according to claim 3, wherein said track members each comprise a pair of transversely spaced track elements.

5. The adjustable spacer assembly according to claim 4 wherein said track elements of said upper wedge comprise rails and said track elements on said lower wedge comprise slots.

6. The adjustable spacer assembly according to claim 5 wherein said rails comprise bulb rails and wherein said bulb rails are formed of a material and proportioned with respect to said slots so that said bulb rails are capable of being snapped into said slots.

* * * * *

UNITED STATES PATENT AND TRADEMARK OFFICE

CERTIFICATE OF CORRECTION

PATENT NO. : 7,703,727 B2
APPLICATION NO. : 11/185846
DATED : April 27, 2010
INVENTOR(S) : Jerry N. Selness It is certified that error appears in the above-identified patent and that said Letters Patent is hereby corrected as shown below:

Please correct in the following on the front page of the patent:

Please delete:
(76) Inventor: Jerry N. Selness, 4811 Monongahela St., San Diego, CA (US) 92117 and replace with:
(76) Inventor: Jerry N. Selness, 4611 Monongahela St., San Diego, CA (US) 92117

Signed and Sealed this

Twentieth Day of July, 2010

David J. Kappos

David J. Kappos
*Director of the United States Patent and Trademark Office*